United States Patent [19]

Salzman

[11] 4,186,500

[45] Feb. 5, 1980

[54] MOLDED CROSS-COUNTRY SKI BOOT

[75] Inventor: Otto Salzman, Dorval, Canada

[73] Assignee: Tyrol Shoe Co. Ltd., Montreal, Canada

[21] Appl. No.: 900,662

[22] Filed: Apr. 27, 1978

[51] Int. Cl.[2] ..... A43B 5/04

[52] U.S. Cl. ..... 36/117; 36/30 R

[58] Field of Search ..... 36/117, 118, 119, 120, 36/121, 76 R, 76 C, 69, 30 R

[56] References Cited

U.S. PATENT DOCUMENTS

| | | | |
|---|---|---|---|
| 3,613,270 | 10/1971 | Eie | 36/117 |
| 3,922,800 | 12/1975 | Miller et al. | 36/117 |

FOREIGN PATENT DOCUMENTS

| | | | |
|---|---|---|---|
| 2613266 | 9/1977 | Fed. Rep. of Germany | 36/117 |
| 1295561 | 12/1962 | France | 36/117 |

*Primary Examiner*—Patrick D. Lawson

*Attorney, Agent, or Firm*—Alan Swabey; Robert Mitchell; Guy J. Houle

[57] ABSTRACT

A cross-country ski boot having a sole and upper section integrally formed of plastics material. The upper section has a toe portion in a front part thereof and a heel portion in a rear part thereof. A foot entrance opening is provided above the heel portion and a securement portion is associated with the foot entrance opening to secure a foot in the boot. A liner is positioned within the upper section over an inner face of the sole section and upper section. The sole and upper sections are molded on a sole plate insert to impart stiffness to the sole section while permitting flexing in the sole along an area transverse to the long axis of the sole section intermediate a front foot and a rear heel portion of the sole to permit the heel portion of the foot to be lifted off a surface while the toe portion of the boot is immovably secured.

9 Claims, 6 Drawing Figures

Fig. 4
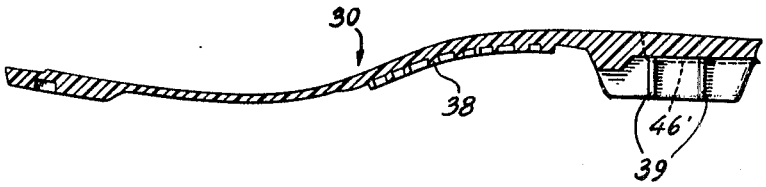
Fig. 5
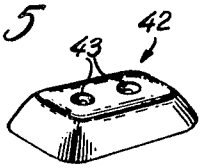
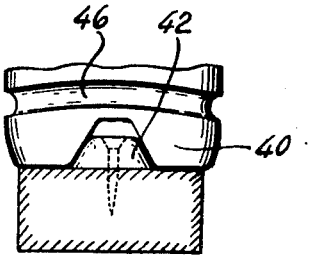
Fig. 6

MOLDED CROSS-COUNTRY SKI BOOT

BACKGROUND OF INVENTION (a) Field of the Invention

The present invention relates to a cross-country ski boot and more particularly to a boot wherein the sole section and at least the lower marginal area of the upper section are integrally molded from a plastics material with the sole section having the necessary stiffness of conventional cross-country ski boots while permitting the desired flexing of the sole.

(b) Description of Prior Art

Heretofore it has not been possible to make a cross-country ski boot with the sole and upper sections integrally molded. One of the reasons why this type of boot construction has not been possible is that the necessary functioning of the boot could not be maintained as the sole and upper sections were either too flexible or rigid when molded together. The sole section would lose its necessary property for torsional rigidity and thereby deforming under lateral pressures applied thereto by one's foot, when in use. However, it is desirable to have such a cross-country ski boot as it would result in a light-weight boot which is waterproof, wear-resistant, easy to clean, long-wearing and easy to produce and further which may be produced in different colours by simply using different colour pigments in the plastics material.

SUMMARY OF INVENTION

It is a feature of the present invention to provide a cross-country ski boot which has all of the above-desired characteristics.

A further feature of the present invention is to provide a cross-country ski boot in which the sole and upper sections are integrally molded of plastics material and wherein the sole is thin and has the torsional rigidity property better than conventional leather or leather and rubber soles, where conventional reinforcement is provided.

A further feature of the present invention is to provide a cross-country ski boot which can be easily produced in different colours.

A further feature of the present invention is to provide a cross-country ski boot wherein the sole section and at least the lower marginal area of the upper section are molded of polyurethane material and wherein a sole plate insert is molded within the sole to provide a torsional rigidity to the boot and wherein the heel of the boot is engageable with a projection mounted on a ski to provide good lateral control of the ski when the boot rests flat on the upper surface of the ski.

According to the above features, from a broad aspect, the present invention provides a cross-country ski boot having a sole section and at least a lower marginal area of an upper section integrally formed of plastics material. The upper section has a toe portion in a front part thereof and a heel portion in a rear part thereof. A foot entrance opening is provided above the heel portion and a securement portion is associated with the foot entrance opening to secure a foot in the boot. A liner is positioned within the upper section over an inner face of the sole section and upper section. The sole section is molded on a sole plate insert which imparts stiffness to the sole while permitting flexing in the sole along an area transverse to the long axis of the sole section intermediate a front foot and a rear heel portion of the sole to permit the heel portion of the foot to be lifted off a surface while the toe portion of the boot is immovably secured to the surface.

BRIEF DESCRIPTION OF DRAWINGS

A preferred embodiment of the present invention will now be described with reference to the example thereof as illustrated in the accompanying drawings in which:

FIG. 4 is a side view of the sole plate insert;

FIG. 5 is a perspective view of a centering projecting element engageable with the heel of the boot; and FIG. 6 is a cross-sectional view of the heel of the ski boot.

DESCRIPTION OF PREFERRED EMBODIMENTS

Figure 1:
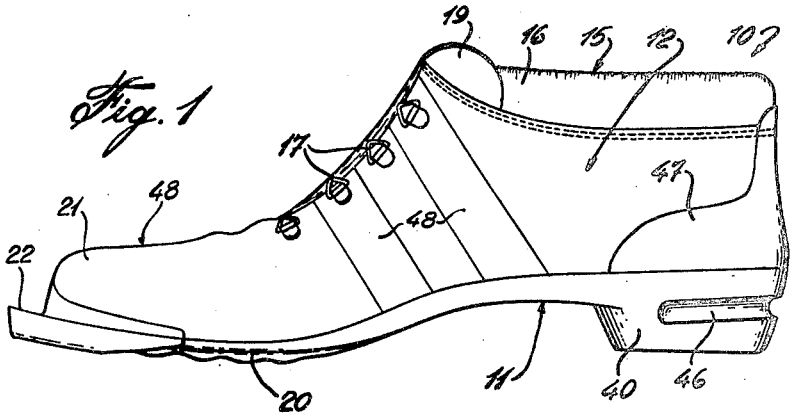
FIG. 1 is a perspective view of the cross-country ski boot of the present invention.
Figure 2:
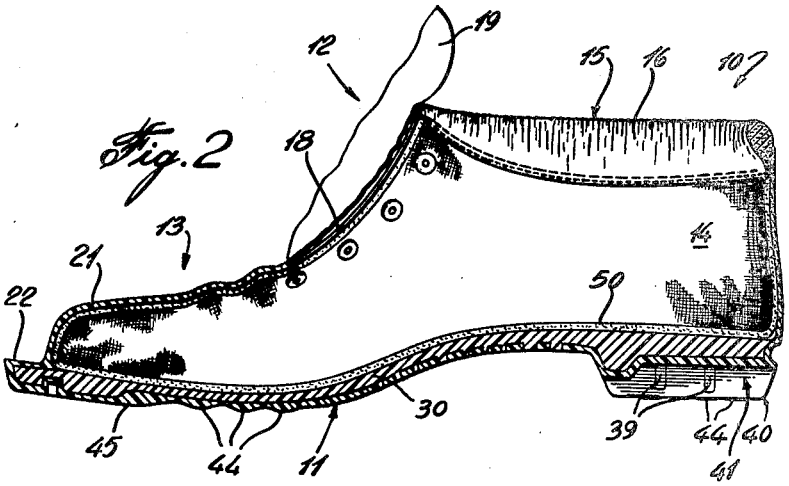
FIG. 2 is a sectional side view of the ski boot of FIG. 1.

Referring now to FIGS. 1 and 2, there is shown generally at 10 the cross-country ski boot of the present invention. The boot 10 comprises a sole section 11 and an upper section 12. As can be more clearly seen in FIG. 2, the sole section 11 is integrally molded of a plastics material, herein polyurethane, with the upper section 12.

The upper section 12 defines a toe portion 13, in a front part thereof, and a heel portion 14, in a rear part thereof. A foot entrance opening 15 is located above the heel portion, and as herein shown, a cushion collar 16 is secured about the opening 15 to protect the lower part of a foot positioned within the boot. A securement means herein in the form of lace rings 17, adapted to receive a lace (not shown), is associated with a front portion 18 of the entrance opening 15 to secure a foot in the boot, as is conventionally known. A tongue 19 spans the front portion 18 and is secured in the conventional manner.

As can be shown in FIG. 1, the sole section has an outer sole edge 20 which lies substantially in the same plane as the outer surface 21 of the upper section 12. An enlarged toe plate section 22 projects from the outer sole edge in a front end of the front foot portion of the sole section to permit the boot to be immovably secured to a ski binding (not shown) and in the conventional manner. It is desirable, although not essential, for the proper flexing of the boot to have the outer surface of the sole edge section 20 substantially in the same plane as the outer surface 21 of the upper and substantially in an area intermediate the toe portion 13 and heel portion 14 of the boot.

Figure 3:
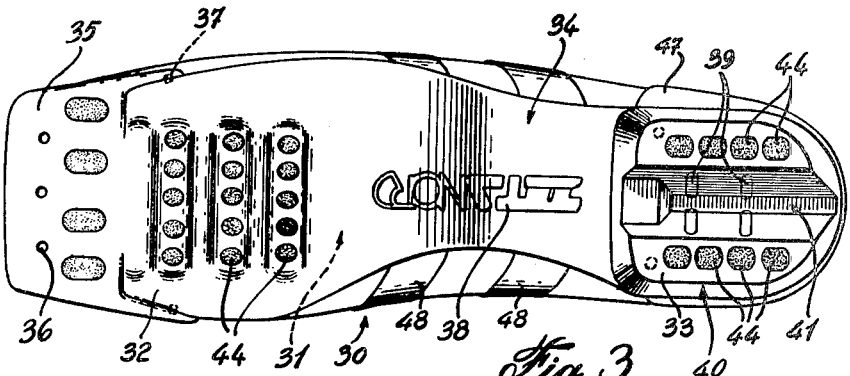
FIG. 3 is a bottom view of the sole plate insert.

Referring now more specifically to FIGS. 2, 3 and 4, it can be seen that the sole section is molded on a sole plate insert 30. The insert 30 imparts stiffness to the sole section to provide torsional rigidity thereof. At the same time, the insert 30 permits flexing of the sole along an area 31 transverse to the long axis of the sole section and which is intermediate a front foot portion 32 and a rear heel portion 33 of the sole insert to permit the heel portion of the boot to be lifted off the surface while the toe portion of the boot is immovably secured to that surface. This stiffness and torsional rigidity is achieved by providing an insert made of a material having a higher stiffness property than the polyurethane plastic material forming the part of the sole section and the upper section of the boot. Also, the area 31 is made thin whereby it is more flexible than the front foot portion 32 or the rear heel portion 33.

The sole plate insert 30 further defines an arch portion 34 intermediate the front foot portion 32 and rear heel portion 33. An enlarged toe plate section 35 is provided in a front end of the front foot portion 32 and has a plurality of holes 36 and 37 therein, with the holes 36 being provided to receive a quantity of polyurethane therein while still providing a hole from the underface of the enlarged toe plate section 22 to engage pins (not shown) normally provided in the bindings of cross-country skis. The holes 37 are provided to receive polyurethane therein to anchor the plastics securely to the insert 30. A projecting anchor means in the form of projections 38 are disposed in a lower face of the arch portion and rear heel portion and integrally formed with the plastics material of the insert to provide further anchoring of the polyurethane material to the sole plate insert. In the rear heel portion these projecting anchor means are wear-resistance guide ribs 39 which also serve other purposes as will be described later.

Referring now to FIG. 2, it can be seen that the heel 40 of the boot defines a longitudinal inverted central heel groove 41 in its lower face and extending along the longitudinal axis of the boot. The groove 41 receives a centering projecting element 42, as shown in FIG. 5, which is secured to a heel section (not shown) of a top face of a ski (not shown) by means of fasteners (not shown) extending through the fastening holes 43. This centering projecting element 42 is received in close fit within the groove 41 to provide lateral engagement with the heel 40 when the heel lies flat on the surface of the ski. The ribs 39 are angulated outwardly and guide the centering projecting element, which has an outward downward taper to maintain the boot centered on the ski when downward pressure is applied against the heel of the boot.

Further referring to FIG. 2, there is shown friction projections 44 formed in the lower outer surface 45 of the sole section 11 and disposed in the front foot and rear heel portions thereof to provide good frictional contact when walking on a hard slippery surface.

Referring again to FIG. 1, it can be seen that a horizontal groove 46, which is accommodated by the heel depression 46' in the insert 30 as shown in FIG. 4, is provided about a rear portion of an outer rear surface of the heel 40. Further, reinforcing layers of thicker polyurethane material extends from the sole section over the upper section in a rear portion 47 of the heel portion 14 and in restricted portions, herein bands 48 in an intermediate area between the heel portion and the toe portion of the upper section 12. These areas reinforce the upper and also provide an aesthetic design thereof. Although not shown, vent holes may be provided along the lower edge of the upper section in the arch portion of the sole to provide ventilation of a liner 50 (see FIG. 2) secured over the inner surface of the sole section and upper section of the boot. This liner is secured in any conventional manner.

It is within the ambit of the present invention to provide any obvious modifications of the examples of the preferred embodiment described hereinabove, provided such modifications fall within the ambit of the broadest claim appended hereto.

I claim:

1. A cross-country ski boot comprising a sole section and an upper section, said sole section and at least the lower marginal area of said upper section being integrally formed of plastics material, said upper section having a toe portion in a front part thereof and a heel portion in a rear part thereof, a foot entrance opening above said heel portion, securement means associated with said foot entrance opening to secure a foot in said boot, a liner within said upper section over an inner face of said sole section and upper section, said sole section being molded on a sole plate insert having a higher stiffness property than said plastics material to impart stiffness and torsional rigidity to said sole while permitting flexing on said sole along an area transverse to the longitudinal axis of said sole section intermediate a front foot and a rear heel portion of said sole to permit said heel portion of said boot to be lifted off a surface while said toe portion of said boot is immovably secured to said surface.

2. A ski boot as claimed in claim 1 wherein said area transverse to the longitudinal axis of said sole section intermediate said front foot and rear heel portions of said sole is a thin flexible area.

3. A ski boot as claimed in claim 2 wherein said sole plate insert further defines an arch portion intermediate said front foot portion and rear heel portion, an enlarged toe plate section in a front end of said front foot portion, said sole plate insert having a smooth upper face, cavities in a lower face of said toe plate section, projecting anchor means in a lower face of said arch portion and rear heel portion, said anchor means being integrally formed in said plastics material to anchor said plastics material to said sole plate insert.

4. A ski boot as claimed in claim 3 wherein said rear heel portion defines a longitudinal inverted central heel groove in said lower face and extending along said longitudinal axis of said sole, said groove receiving a centering projecting element securable to a heel section of a top face of a ski to be received in close fit in said heel groove to provide lateral engagement of said heel with said heel section of said ski.

5. A ski boot as claimed in claim 4 wherein said heel groove is provided with wear resistant guide ribs, said wear resistant guide ribs being in friction guide contact with said centering projecting element and constituting said projecting anchor means in said rear heel portion of said sole plate insert.

6. A ski boot as claimed in claim 5 wherein friction projections are provided on a lower outer surface of said sole section and disposed in the front foot and rear heel portions thereof.

7. A ski boot as claimed in claim 6 wherein a groove is provided about a rear portion of an outer rear surface of said heel portion, and reinforcing layers of plastic material extending from said sole section over said upper section in a rear portion of said heel portion and in restricted portions of an intermediate area between said heel portion and said toe portion of said upper section.

8. A ski boot as claimed in claim 1 wherein said upper section is entirely formed of a polyurethane plastics material, and said liner being secured to a portion of an inner surface of said upper section.

9. A ski boot as claimed in claim 1 wherein said sole section has an outer sole edge which lies substantially in the same plane as an outer surface of said upper section, and an enlarged toe plate section projecting from said outer sole edge in a front end of said front foot portion of said sole section to permit said immovable securement of said boot.

* * * * *